US007251447B2

(12) United States Patent
Kanamori et al.

(10) Patent No.: US 7,251,447 B2
(45) Date of Patent: Jul. 31, 2007

(54) IMAGE HEATING APPARATUS AND CONVEYING ROLLER FOR USE THEREIN

(75) Inventors: Akihito Kanamori, Numazu (JP); Satoru Izawa, Shizuoka-ken (JP); Fumiki Inui, Mishima (JP); Hiroto Hasegawa, Mishima (JP); Eiji Uekawa, Mishima (JP); Shinji Hashiguchi, Mishima (JP); Koji Nihonyanagi, Susono (JP); Toshiya Kaino, Susono (JP); Masami Takeda, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 75 days.

(21) Appl. No.: 11/091,638

(22) Filed: Mar. 29, 2005

(65) Prior Publication Data

US 2005/0244200 A1 Nov. 3, 2005

(30) Foreign Application Priority Data

Mar. 30, 2004 (JP) ..... 2004-099651
Mar. 25, 2005 (JP) ..... 2005-087831

(51) Int. Cl.
*G03G 15/20* (2006.01)
*H05B 1/00* (2006.01)
*H05B 3/00* (2006.01)
*H05B 11/00* (2006.01)

(52) U.S. Cl. ..... 399/333; 399/331; 219/216

(58) Field of Classification Search ..... 399/328, 399/331, 333; 347/156; 219/216
See application file for complete search history.

(56) References Cited

U.S. PATENT DOCUMENTS 3,884,623 A * 5/1975 Slack ..... 219/216 X
3,999,038 A * 12/1976 Sikes et al. ..... 219/216 X
4,042,804 A * 8/1977 Moser ..... 219/216
4,594,068 A * 6/1986 Bardutzky et al. ..... 219/216 X
4,970,219 A 11/1990 Effland et al. ..... 514/339
4,983,615 A 1/1991 Effland et al. ..... 514/337
5,034,403 A 7/1991 Effland et al. ..... 514/338
5,083,168 A 1/1992 Kusaka et al. ..... 355/285

(Continued)

FOREIGN PATENT DOCUMENTS

JP 62-84065 4/1987
JP 63-313182 12/1988
JP 2-157878 6/1990
JP 3-233586 10/1991
JP 4-44075 2/1992

(Continued)

*Primary Examiner*—Sandra L. Brase
(74) *Attorney, Agent, or Firm*—Fitzpatrick, Cella, Harper & Scinto

(57) ABSTRACT

An image heating apparatus for heating an image formed on a recording material, the apparatus including a conveying roller for conveying a recording material, the conveying roller including a metal core and an elastic layer provided outside the metal core, wherein the metal core has, in a central portion in the longitudinal direction thereof, a straight shape area having a substantially uniform diameter along the longitudinal direction and tapered shape areas, on both sides of the straight shape area, in which a diameter gradually decreases toward ends in the longitudinal direction, and wherein the elastic layer has, in a central portion in the longitudinal direction thereof, a straight shape area having a substantially uniform diameter along the longitudinal direction and inverted crown shape areas, on both sides of the straight shape area, in which a diameter gradually increases toward ends in the longitudinal direction. This configuration allows to prevent defects in image heating while suppressing creases in the recording material.

15 Claims, 12 Drawing Sheets

U.S. PATENT DOCUMENTS

| | | | | |
|---|---|---|---|---|
| 5,149,941 | A | 9/1992 | Hirabayashi et al. | 219/216 |
| 5,162,634 | A | 11/1992 | Kusaka et al. | 219/216 |
| 5,210,579 | A | 5/1993 | Setoriyama et al. | |
| 5,221,682 | A | 6/1993 | Effland et al. | 514/349 |
| 5,262,834 | A | 11/1993 | Kusaka et al. | |
| 5,300,997 | A | 4/1994 | Hirabayashi et al. | |
| 5,343,280 | A | 8/1994 | Hirabayashi et al. | |
| 5,405,856 | A | 4/1995 | Effland et al. | 514/349 |
| 5,450,181 | A | 9/1995 | Tsukida et al. | |
| 5,525,775 | A | 6/1996 | Setoriyama et al. | 219/216 |
| 5,722,026 | A | 2/1998 | Goto et al. | 399/333 |
| 5,767,484 | A | 6/1998 | Hirabayashi et al. | 219/216 |
| 5,920,757 | A | 7/1999 | Izawa et al. | 399/329 |
| 6,005,594 | A | 12/1999 | Nanataki et al. | 347/156 |
| 6,075,228 | A | 6/2000 | Goto et al. | 219/216 |
| 6,393,247 | B1 * | 5/2002 | Chen et al. | 399/331 X |
| 6,518,546 | B2 * | 2/2003 | Otsuka et al. | 219/216 |
| 6,519,426 | B2 | 2/2003 | Goto et al. | 399/69 |
| 6,671,488 | B2 | 12/2003 | Izawa et al. | 399/329 |
| 6,713,725 | B2 | 3/2004 | Izawa et al. | 219/216 |
| 6,748,192 | B2 | 6/2004 | Izawa et al. | 399/329 |
| 6,763,205 | B2 | 7/2004 | Izawa et al. | 399/69 |
| 6,787,737 | B2 | 9/2004 | Uekawa et al. | 219/216 |
| 6,794,611 | B2 | 9/2004 | Kataoka et al. | 219/216 |
| 6,862,416 | B2 | 3/2005 | Hashiguchi et al. | 399/69 |
| 6,915,099 | B2 | 7/2005 | Izawa et al. | 399/328 |
| 6,944,420 | B2 | 9/2005 | Kanamori et al. | 399/329 |
| 6,961,532 | B2 | 11/2005 | Uekawa et al. | 399/329 |
| 2005/0244200 | A1 | 11/2005 | Kanamori et al. | 399/333 |
| 2006/0008286 | A1 | 1/2006 | Nihonyanagi et al. | 399/69 |
| 2006/0056891 | A1 | 3/2006 | Hashiguchi et al. | 399/329 |

FOREIGN PATENT DOCUMENTS

| | | | |
|---|---|---|---|
| JP | 4-204980 | | 7/1992 |
| JP | 6-102792 | | 4/1994 |
| JP | 6-324588 | | 11/1994 |
| JP | 7-121043 | | 5/1995 |
| JP | 8-30128 | | 2/1996 |
| JP | 9-152803 | | 6/1997 |
| JP | 09-152803 | * | 6/1997 |
| JP | 9-197864 | | 7/1997 |
| JP | 10-198206 | | 7/1998 |

* cited by examiner

IMAGE HEATING APPARATUS AND CONVEYING ROLLER FOR USE THEREIN

BACKGROUND OF THE INVENTION

1. Field of the Invention

The present invention relates to an image heating apparatus adapted for use as a fixing apparatus mounted in a copying apparatus or a printer utilizing a recording technology as an electrophotographic recording method or an electrostatic recording method, and a conveying roller for use in such apparatus.

2. Related Background Art

A copying apparatus or a printer of an electrophotographic process is equipped with a fixing apparatus for heat fixing a toner image formed on a recording material. Such fixing apparatus is available in various types, such as a heat roller type in which a fixing roller heated by an internal halogen lamp and a pressure roller pinch and convey a recording material to execute a heat fixing thereof, an on-demand type (also called film heating type) in which a ceramic heater is contacted with an internal surface of a flexible sleeve (fixing film or fixing belt) formed by a heat-resistant resin or a metal, and a recording material is heated by a fixing nip portion formed by the ceramic heater and a pressure roller, and an electromagnetic induction heating type in which a rotary member itself in contact with a recording material generates heat. In any of these types, a fixing nip portion formed between a fixing roller (or a heater) and a pressure roller pinches and conveys a recording material thereby heat fixing a toner image thereon.

In case of employing an ordinary paper as the recording material, it is necessary to avoid formation of creases in the course of a fixing step. A principal cause of crease formation in the ordinary paper is a shrinkage of paper fibers by an excessive heat supply. As a countermeasure against such phenomenon, there is known a method of employing a fixing roller or a pressure roller (hereinafter such rollers being collectively called a conveying roller) having an inverted crown shape, in which diameter becomes larger from a central portion toward both end portions in the longitudinal direction. For example, a conveying roller, having a metal core of a uniform diameter over the longitudinal direction and an elastic layer provided around the metal core and having a thickness gradually increasing toward the end portions in the longitudinal direction, generates a force of stretching an ordinary paper in the course of the fixing step, thereby suppressing creasing in the ordinary paper.

However, in an ordinary fixing apparatus, in order to form the fixing nip portion, a pressure is applied for example by a spring between an end of the fixing heater (or heater) and an end of the pressure roller, and also between the other end of the fixing roller (or heater) and the other end of the pressure roller. As the nip portion is formed by applying a force in each of both ends of the apparatus, the roller itself shows a certain bending even though the roller has a metal core, so that the fixing nip at the central portion in the longitudinal direction of the roller becomes narrower than in both end portions, thus tending to result in a deficient pressure. Besides, in case of employing a conveying roller having an inverted crown profile as explained above, a further deficiency in pressure tends to be generated in the central portion in the longitudinal direction of the roller, thereby leading to a fixing failure or a toner offsetting.

On the other hand, the pressure roller not internally provided with a heat source tends to show a temperature change by an operation status of the printer. For example in a continuous printing operation of printing on plural recording materials in succession, a large amount of heat is taken away by the recording materials, so that the temperature of the pressure roller does not become very high (for example about 80-90° C.). On the other hand, in an intermittent printing operation in which a preceding recording material and a succeeding recording material have a long interval, a heat amount supplied from the fixing roller (or heater) supplied during such interval becomes larger so that the pressure roller tends to assume a high temperature (for example about 140-150° C.). A fixing property of the toner image is influenced by a heat amount and a pressure given thereto, and a fixing failure and a toner offsetting tend to be generated in a continuous printing operation in which the pressure roller has a low temperature whereby the heat amount given to the recording material and the toner image tends to become low. On the other hand, in an intermittent printing operation, even if the pressure applied to the central portion in the longitudinal direction of the roller is deficient, the fixing failure or the toner offsetting is not generated as in the continuous printing operation as the pressure roller has a high temperature.

Thus, a configuration of merely employing a pressure roller of an inverted crown shape can suppress creases on the recording material but cannot necessarily satisfy a fixing property, and it is very difficult to obtain an ability of suppressing creases and a satisfactory fixing property at the same time. It is therefore conceived to adopt a metal core of a tapered shape in which the diameter becomes gradually smaller from a central portion in the longitudinal direction toward both end portions and to provide an elastic layer in such a manner that the pressure roller has a straight or inverted crown profile at the room temperature (about 10-30° C.) (cf. FIG. 11 and Japanese Patent Application Laid-open No. H09-152803). Also FIG. 9 shows a profile in a thermally expanded state of a pressure roller employing a metal core of a tapered shape and having an inverted crown profile at the room temperature state. Also FIG. 10 shows a profile in a thermally expanded state of a pressure roller employing a metal core of a tapered shape and having a straight profile at the room temperature state.

Such pressure roller, having a large thickness in the elastic layer on both end portions even though having a profile of a straight shape or a little inverted crown shape at the room temperature state, assumes an appropriate inverted crown shape by a thermal expansion of the elastic layer at a high temperature state of the pressure roller (about 140-150° C.), and is therefore capable of suppressing creases that tend to be generated at a high temperature in the ordinary paper. Also showing a smaller inverted crown shape at a temperature of about 80-90° C. where a fixing failure is often generated, it can suppress a decrease in the pressure in the central portion in the longitudinal direction of the roller, whereby it is rendered possible to suppress, to a certain level, a fixing failure or a toner offsetting that is often generated in a temperature range of the pressure roller of 80-90° C.

However, as the metal core of such pressure roller is tapered from a center line in the longitudinal direction toward both ends, the elastic layer in its entire area only shows a monotonous increase in the thickness from the center line in the longitudinal direction toward the both ends. Stated differently, the metal core does not have an area of a uniform diameter in a central portion in the longitudinal direction, and also the elastic layer does not have an area of a uniform thickness in the central portion in the longitudinal direction. Consequently, the elastic layer, when thermally expanded, assumes a V-shaped cross sectional form with a bottom of a recess in the central portion (cf. FIGS. 9 and 10), and is not sufficient in suppressing the fixing failure and the toner offsetting because of presence of such local recessed shape.

Also in a heat fixing apparatus of film heating type, a temperature detecting element for detecting the temperature of a heater is provided on a rear surface of the heater, corresponding to a central portion in the longitudinal direction of the pressure roller, and a current supply control to the heater is executed based on thus detected temperature. Therefore, in case a local concave shape is formed in the central portion of the pressure roller as explained above, the pressure roller takes away, in the central portion, a smaller heat amount from the heater through a fixing film, than in the both end portions, so that the heater temperature tends to become higher in the central portion. For this reason, the temperature detecting element tends to shows a higher detected temperature, thereby maintaining the heater at a temperature lower than an actually desired control temperature and leading to a fixing failure.

SUMMARY OF THE INVENTION

The present invention has been made in consideration of the foregoing situation, and an object of the present invention is to provide an image heating apparatus capable suppressing creases in a recording material and at the same time suppressing a failure in image heating, and a conveying roller adapted for use in such apparatus.

Another object of the present invention is to provide an image heating apparatus including a conveying roller for conveying a recording material, the conveying roller including a metal core and an elastic layer provided outside the metal core; wherein the metal core including a straight shape area, in a central portion of a longitudinal direction thereof, having a substantially uniform diameter along the longitudinal direction, and tapered shape areas, on both sides of the straight shape area, in which a diameter gradually decreases toward ends in the longitudinal direction; and wherein the elastic layer including a straight shape area, in a central portion of a longitudinal direction thereof, having a substantially uniform diameter along the longitudinal direction, and inverted crown shape areas, on both sides of the straight shape area, in which a diameter gradually increases toward ends in the longitudinal direction.

Still another object of the present invention is to provide a conveying roller including a metal core; and an elastic layer provided outside the metal core; wherein the metal core including a straight shape area, in a central portion of a longitudinal direction thereof, having a substantially uniform diameter along the longitudinal direction, and tapered shape areas, on both sides of the straight shape area, in which a diameter gradually decreases toward ends in the longitudinal direction; and wherein the elastic layer including a straight shape area, in a central portion of a longitudinal direction thereof, having a substantially uniform diameter along the longitudinal direction, and inverted crown shape areas, on both sides of the straight shape area, in which a diameter gradually increases toward ends in the longitudinal direction.

Still other objects of the present invention will become fully apparent from following detailed description which is to be taken in conjunction with the accompanying drawings.

DETAILED DESCRIPTION OF THE PREFERRED EMBODIMENTS

First Embodiment

In the following there will be explained, with reference to the accompanying drawings, a first embodiment of a conveying roller of the present invention, and an image forming apparatus equipped with a heat-fixing apparatus (image heating apparatus) provided with such conveying roller. The present embodiment employs an image forming apparatus having a maximum conveyable width of the recording material (hereinafter called maximum sheet width) corresponding to an LTR size (216 mm in a width perpendicular to the conveying direction of the recording material) and of so-called center reference type in which a reference position for the conveying operation is provided at the center of a length in such perpendicular direction.

(1) Image Forming Apparatus M

Figure 1:
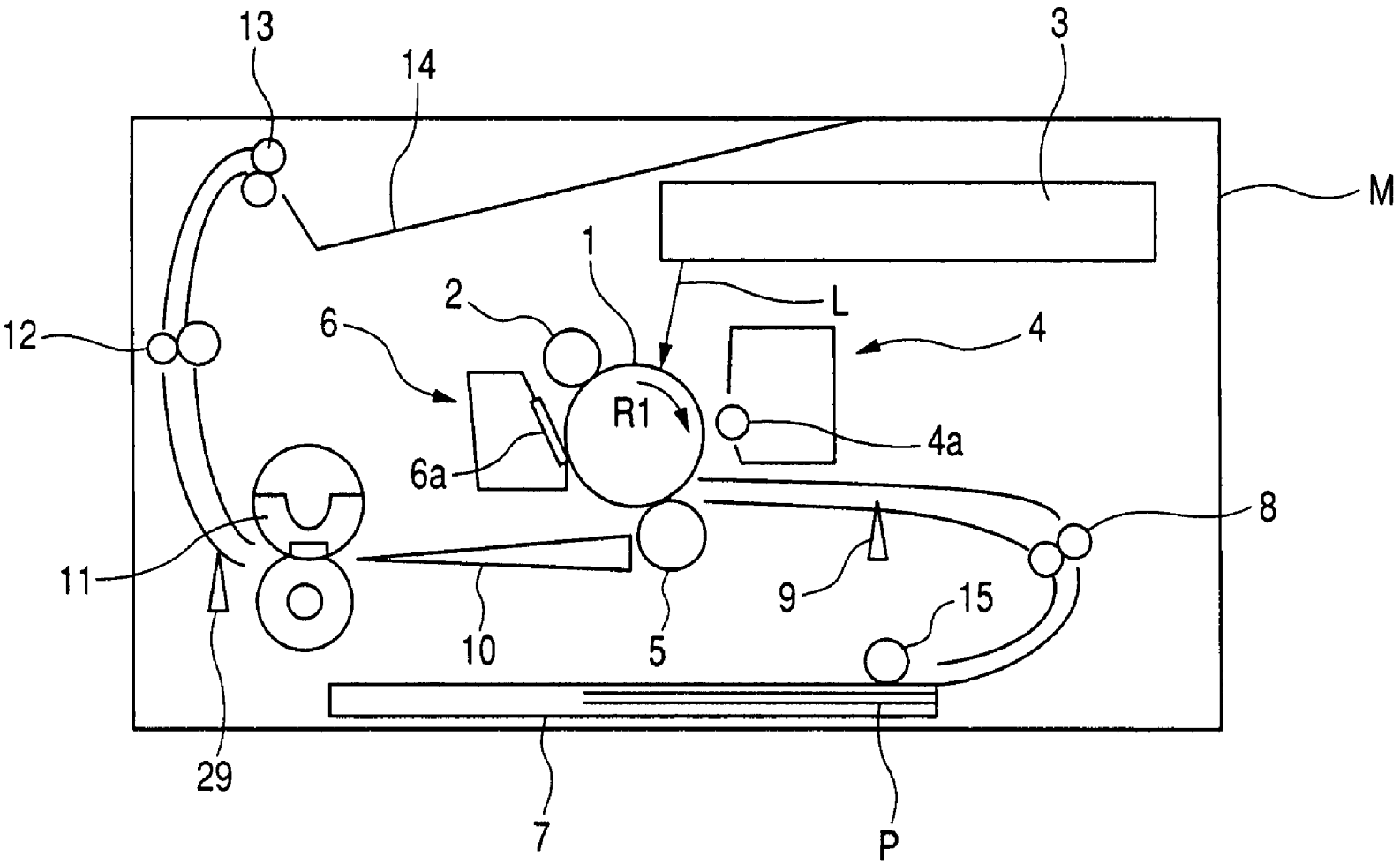
FIG. 1 is a cross-sectional view of an electrophotographic image forming apparatus equipped with an image heating apparatus of the present invention.

At first, there will be explained, with reference to FIG. 1, a configuration of a laser beam printer (hereinafter called image forming apparatus) as an example of the image forming apparatus. FIG. 1 shows a configuration of an image forming apparatus.

The image forming apparatus shown in FIG. 1 is provided with a drum-shaped electrophotographic photosensitive member (hereinafter called photosensitive drum) 1 serving as an image bearing member. The photosensitive drum 1 is rotatably supported in a main body M of the apparatus, and is rotated with a predetermined process speed in a direction R1 by drive means (not shown). Around the photosensitive drum 1 and along the rotating direction thereof, there are provided a charging roller (charging apparatus) 2, exposure means 3, a developing apparatus 4, a transfer roller (transfer apparatus) 5, and a cleaning apparatus 6. In the present embodiment, the photosensitive drum 1, the charging roller 2, the exposure means 3, the developing apparatus 4 and the transfer roller 5 constitute image forming means.

Also in a lower part of the main body M of the apparatus, a sheet feed cassette 7 containing a sheet-shaped recording material P such as paper is provided, and, along a conveying path of the recording material P and in the order from an upstream side, there are provided in succession, a feed roller 15, conveying rollers 8, a top sensor 9, a conveying guide 10, a heat-fixing apparatus 11 according to the invention, a discharge sensor 29, conveying rollers 12, discharge rollers 13 and a discharge tray 14.

In the following, there will be explained a function of the image forming apparatus of the above-described configuration. The photosensitive drum 1, rotated in the direction R1 by the drive means (not shown) is uniformly charged at a predetermined potential of a predetermined polarity by the charging roller 2. The photosensitive drum 1 after charging is surfacially exposed to a laser light L, based on image information, by the exposure means 3 such as a laser optical system, whereby the charge in an exposed portion is dissipated to form an electrostatic latent image.

The electrostatic latent image is developed by the developing apparatus 4. The developing apparatus 4 is provided with a developing roller 4*a*, which is given a developing bias to deposit a toner onto the electrostatic latent image on the photosensitive drum 1, thereby developing a toner image (visible image). The toner image is transferred by the transfer roller 5 onto a recording material P such as paper.

The recording material P is contained in the feed cassette 7, then fed by the feeding roller 15, conveyed by the conveying rollers 8 and is conveyed through the top sensor 9 to a transfer nip portion between the photosensitive drum 1 and the transfer roller 5. In this operation, the recording material P is detected at a leading end thereof by the top sensor 9, and is thus synchronized with the toner image on the photosensitive drum 1. The transfer roller 5 is given a transfer bias thereby transferring the toner image from the photosensitive drum 1 onto a predetermined position of the recording material P.

The recording material P, bearing an unfixed toner image on the surface by the transfer operation, is conveyed along the conveying guide 10 to the heat fixing apparatus 11, in which the unfixed toner image is heated and pressurized thus being fixed to the surface of the recording material P. The heat fixing apparatus 11 will be explained later in more details.

The recording material P after the toner image fixation is conveyed by the conveying rollers 12 and discharged by the discharge rollers 13 onto the discharge tray 14 provided on an upper surface of the main body M of the apparatus.

On the other hand, on the photosensitive drum 1 after the transfer of the toner image, a residual toner not transferred onto the recording material P but remaining on the surface is eliminated by a cleaning blade 6*a* of the cleaning apparatus 6, and is used for a next image formation.

The image formation can be executed in succession by repeating the above-described operations.

(2) Heat-Fixing Apparatus (Image Heating Apparatus) 11

Figure 2:
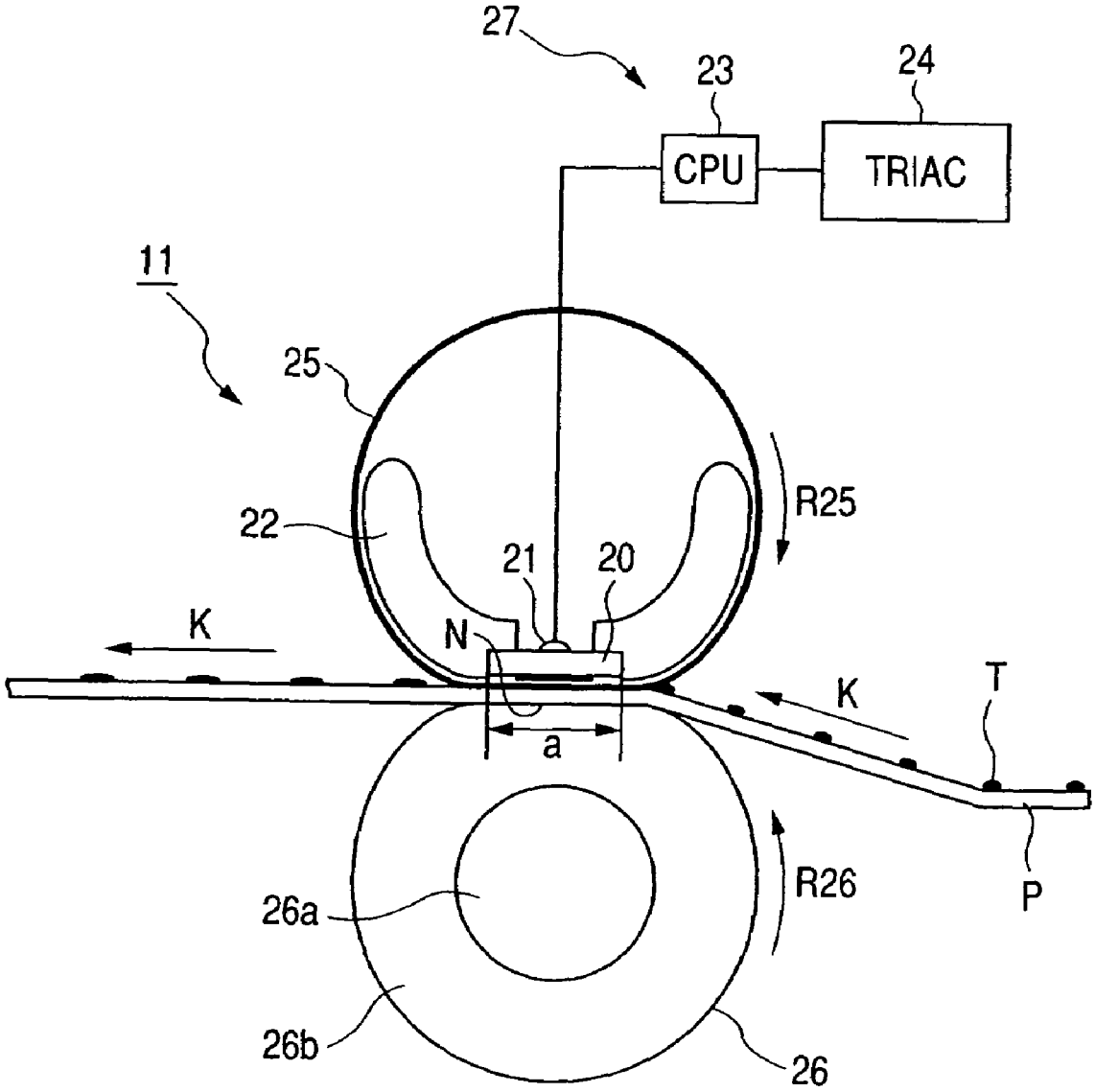
FIG. 2 is a cross-sectional view of a heat fixing apparatus.

In the following, an example of the heat-fixing apparatus 11 of the invention will be explained with reference to FIG. 2. FIG. 2 is a cross-sectional view along a conveying direction (indicated by an arrow K) of the recording material P. The heat fixing apparatus shown in FIG. 2 is a fixing apparatus of a pressure roller driving method in which a fixing film is driven by a pressure roller.

The fixing apparatus 11 is constituted, as principal components, of a ceramic heater (hereinafter called heater) 20 serving as a heating member for heating toner, a fixing film 25 serving as a flexible sleeve surrounding the heater 20, a pressure roller 26 serving as a conveying roller in contact with the fixing film 25, and temperature control means 27 for controlling the temperature of the heater 20.

The heater 20 and the pressure roller 26 are mutually pressed through the fixing film 25, thus constituting a fixing nip portion N. The pressure roller 26 is driven counterclockwise indicated by an arrow R26, thereby exerting a rotary force on the fixing film 25 by the contact frictional force of the pressure roller 26 and the fixing film 25 at the fixing nip portion N. Such rotary force causes the fixing film 25 to rotate clockwise as indicated by an arrow R25, in a sliding contact with a lower surface of the heater 20.

Then an electric power is supplied to the heater 20 to elevate the temperature thereof thereby executing a temperature control at a predetermined temperature. In this state, the recording material P bearing an unfixed toner image T is introduced between the fixing film 25 and the pressure roller 26 in the fixing nip portion N. In the fixing nip portion N, a toner image bearing surface of the recording material P is contacted with an external surface of the fixing film 25, and is pinched and conveyed in the fixing nip portion N together with the fixing film 25. In such pinched conveying process, the heat of the heater 20 is given to the recording material P through the fixing film 25, whereby the unfixed toner image on the recording material P is heated and pressed to the recording material P and fused and fixed thereto. The recording material P after passing the fixing nip portion N is separated by a curvature from the fixing film 25.

(Heater 20)

Figure 3:
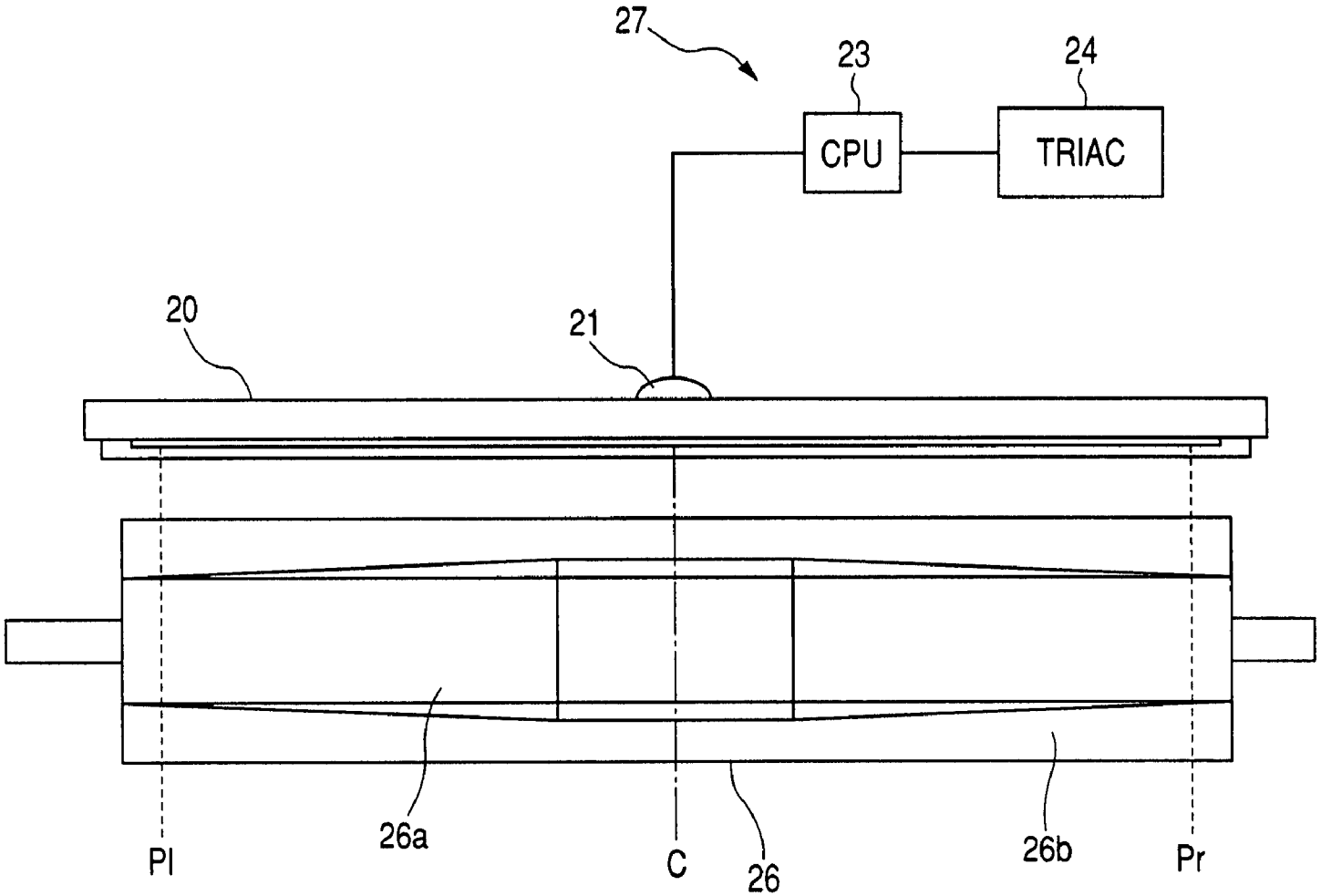
FIG. 3 is a cross-sectional view of a pressure roller.

The heater 20 is constituted by forming in succession, on a ceramic substrate, a heat generating member formed by printing a heat-generating paste and a glass coating layer for protecting and insulating the heat-generating member. The heater 20 generates a heat by supplying a power-controlled AC current to the heat-generating member on the heater 20. The ceramic substrate is formed for example of aluminum nitride or aluminum oxide. On a rear surface of the ceramic substrate, as shown in FIG. 3, a thermistor (temperature detecting element) 21 for temperature control is contacted at an approximate center of the longitudinal direction. The heater 20 is elongated in a lateral direction perpendicular to a conveying direction (indicated by an arrow K) of the recording material P and made longer than a width of the recording material P. The heater 20 is supported by a guide part of the heater holder 22 mounted on the heat-fixing apparatus 11. The guide part of the heater holder 22 is a semi-circular member formed with a heat-resistant resin, and serves also as a guide member for guiding the rotary motion of the fixing film to be explained later.

The present embodiment employed, as an example, a heater 20 prepared by screen printing a silver-palladium alloy as the heat-generating member on a highly insulating substrate of aluminum nitride and applying a glass coating as an insulating protective layer.

(Temperature Control Means 27)

Temperature control means 27 includes a CPU 23 which controls a triac 24, based on a temperature detected by the temperature detecting element (thermistor) 21 mounted at the approximate center of the rear surface of the heater 20, thereby controlling a power supply to the heater 20.

(Fixing Film (Flexible Sleeve) 25)

The fixing film 25 is shaped as an endless belt and is loosely fitted on the heater 20 and the guide part of the heater holder 22. The fixing film 25 is pressed by the pressure roller 26 to the heater 20, whereby an internal periphery of the fixing film 25 is contacted with a lower surface of the heater 20. Thus the fixing film 25 is rotated in a direction R25 along with the conveying of the recording material P in a direction K by the rotation of the pressure roller 26 in a direction R26.

The fixing film 25 is restricted at both lateral ends thereof by a guide portion (not shown) of the guide part of the heater holder 22, so as not to be disengaged from the longitudinal direction of the heater 20. Also on the internal surface of the fixing film 25, grease is coated in order to reduce a sliding resistance with the heater 20 and the guide part of the heater guide 22.

The fixing film 25 of the present embodiment is a metal sleeve formed by coating, on a surface of a cylindrical base tube (base layer), a primer layer and a releasing layer. The cylindrical base tube (base layer) is formed by a heat-resistant metal or alloy of a high thermal conductivity such as SUS (stainless steel), Al, Ni, Cu or Zn. The fixing film may also be based, in place for such metal, on a heat-resistant resin such as polyimide. The releasing layer is formed by mixing a filler for resistance adjustment in a resin such as PTFE, PFA or FEP. The coating can be achieved, for example, by washing the surface of the base layer of the fixing film and by dip coating a primer layer serving as an adhesive and then a releasing layer.

The present embodiment employed, as an example, a base layer of SUS of a thickness of 40 μm, an electroconductive primer layer of a thickness of 5 μm and a releasing layer of a medium resistance of a thickness of 10 μm.

(Pressure Roller (Conveying Roller) 26)

The pressure roller 26 is formed by providing, on an external periphery of a metal core 26*a*, an elastic layer 26*b* of heat-resistant rubber such as silicone rubber or fluorinated rubber, or an elastic layer of foamed sponge. The external periphery of the elastic layer 26*b* contacts the external periphery of the fixing film 25. The heater 20 and the pressure roller 26 constitute, across the fixing film 25, the fixing nip portion N for pinching and conveying the recording material. In the fixing nip portion N, a width (nip width) a in the rotating direction of the pressure roller 26 is so selected as to advantageously heat and press the toner on the recording material P.

Also as shown in FIG. 3, the image forming apparatus of the present embodiment passes the recording material P using the center position as a reference. A conveying reference C of the recording material P becomes substantially same as the center of the pressure roller 26 in the longitudinal direction thereof, and the installed position of the thermistor 21 mounted on the rear surface of the heater 20.

In the following, shapes of the metal core and the elastic layer of the pressure roller will be explained.

Figure 4:
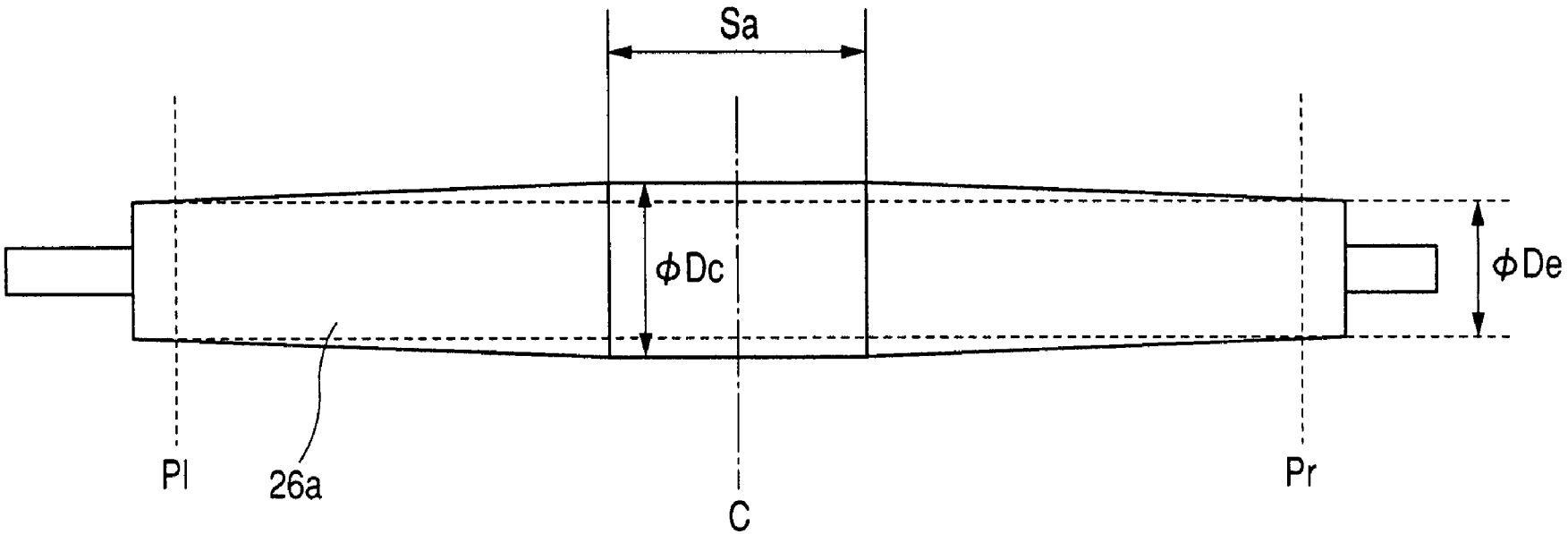
FIG. 4 is a lateral view of a metal core of the pressure roller.

As shown in FIG. 4, the metal core 26*a* has a straight portion Sa (straight shaped area) whose diameter is ϕDc as a maximum constant diameter and length is Sa from an imaginary center line C toward both sides in a longitudinal direction, and tapered shaped portions whose diameters decrease from both ends of the straight portion Sa toward both ends of the metal core whose diameters at both ends of the metal core are ϕDe as minimum diameters. That is, the metal core 26*a* has a straight shaped area whose diameter is substantially uniform in a longitudinal direction at a center part of the metal core and tapered shaped areas whose diameters gradually decrease from both sides of the straight portion toward both ends of the metal core in a longitudinal direction.

Figure 5:
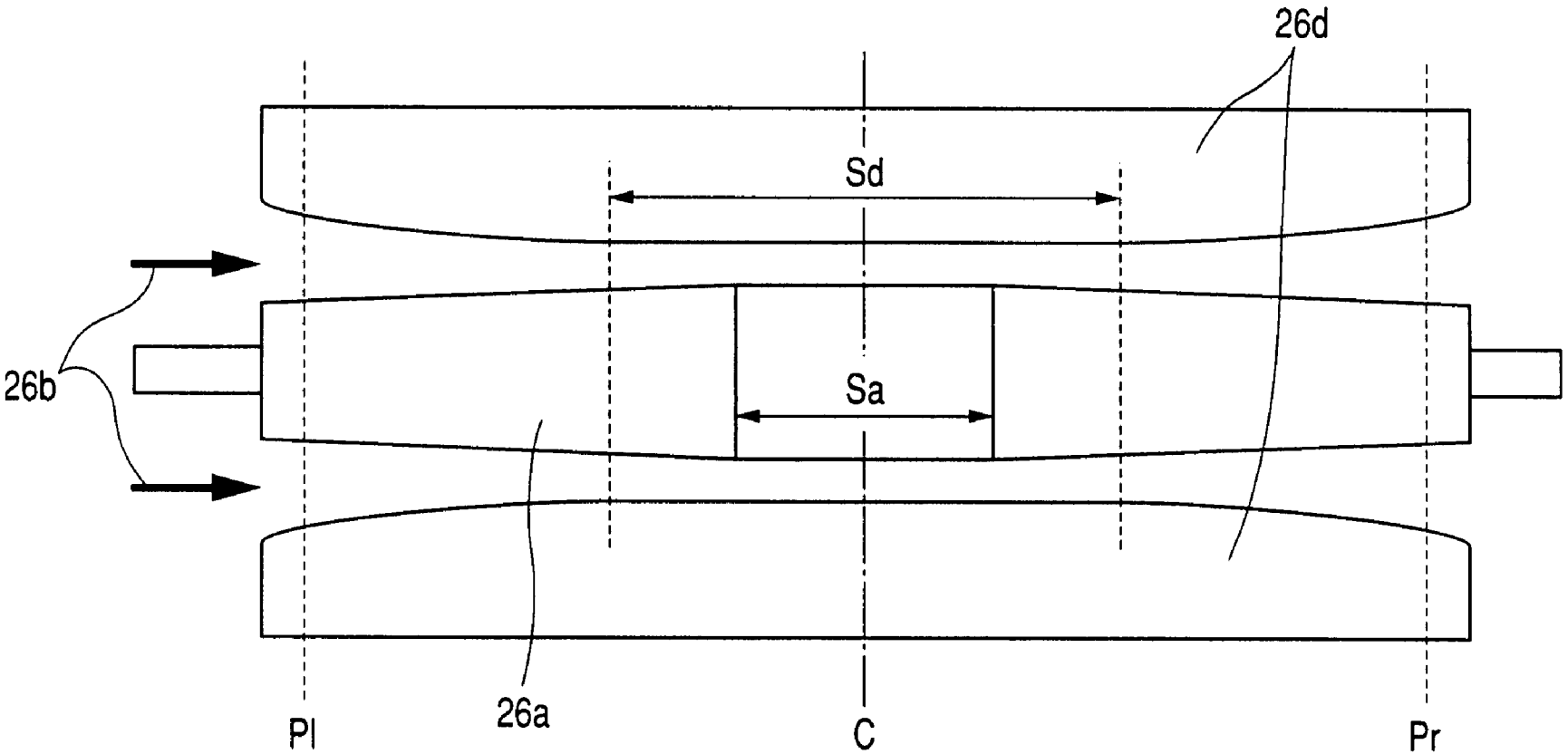
FIG. 5 is a lateral view showing a mounted state of the metal core in a metal mold for molding a rubber material.

Then there will be explained a shape of the elastic layer of the pressure roller, by explaining a shape of a metal mold 26*d* for forming the elastic layer of the pressure roller and a process for molding the elastic layer around the metal core 26*a*. FIG. 5 is a cross sectional view of the metal mold 26*d* in which the metal core 26*a* is mounted.

An internal surface of the metal mold 26*d*, as shown in FIG. 5, has a straight portion Sd of a length Sd, based on the imaginary center line C in the longitudinal direction, longer than the straight portion (Sa) of the metal core 26*a* and capable of laterally symmetrically covering at least the straight portion (Sa) of the metal core 26*a*. The metal mold 26*d* also has a crown shape of a curve in the manner of a second-order function from the ends of the straight portion Sd toward both ends. As will be explained later in more details, a crown amount of the internal surface of the metal mold 26*d* is so selected that both end portions of the elastic layer 26*b* have a predetermined inverted crown amount with respect to the straight shape area at the center, even when the pressure roller 26 is in a room temperature state, namely even when the elastic layer 26*b* is in a contracted state.

The metal core 26*a* is mounted in the metal mold 26*d* as shown in FIG. 5, and a precursor of an elastic material is poured from a direction indicated by an arrow and is hardened by heating (about 100-130° C.) to form an elastic layer 26*b* around the metal core. Therefore, a shape of the elastic layer 26*d* immediately after the molding, namely in a state where the elastic layer is in a high temperature state, is close to the shape of the internal surface of the metal mold 26*d*. The elastic layer, in a high temperature state, assumes a surface shape as shown by broken line in FIG. 6.

The pressure roller 26 thus constructed, in which a rubber material such as silicone rubber constituting the elastic layer 26*b* has a property of expanding and contracting depending on the temperature, tends to show different external profiles at a room temperature (23 ±5°C.) and at a high temperature state (100°C. or higher) when the temperature of the pressure roller is elevated by a continuous printing operation.

In the following there will be explained a shape of the elastic layer at the room temperature state, namely when the pressure roller is cooled.

Figure 6:
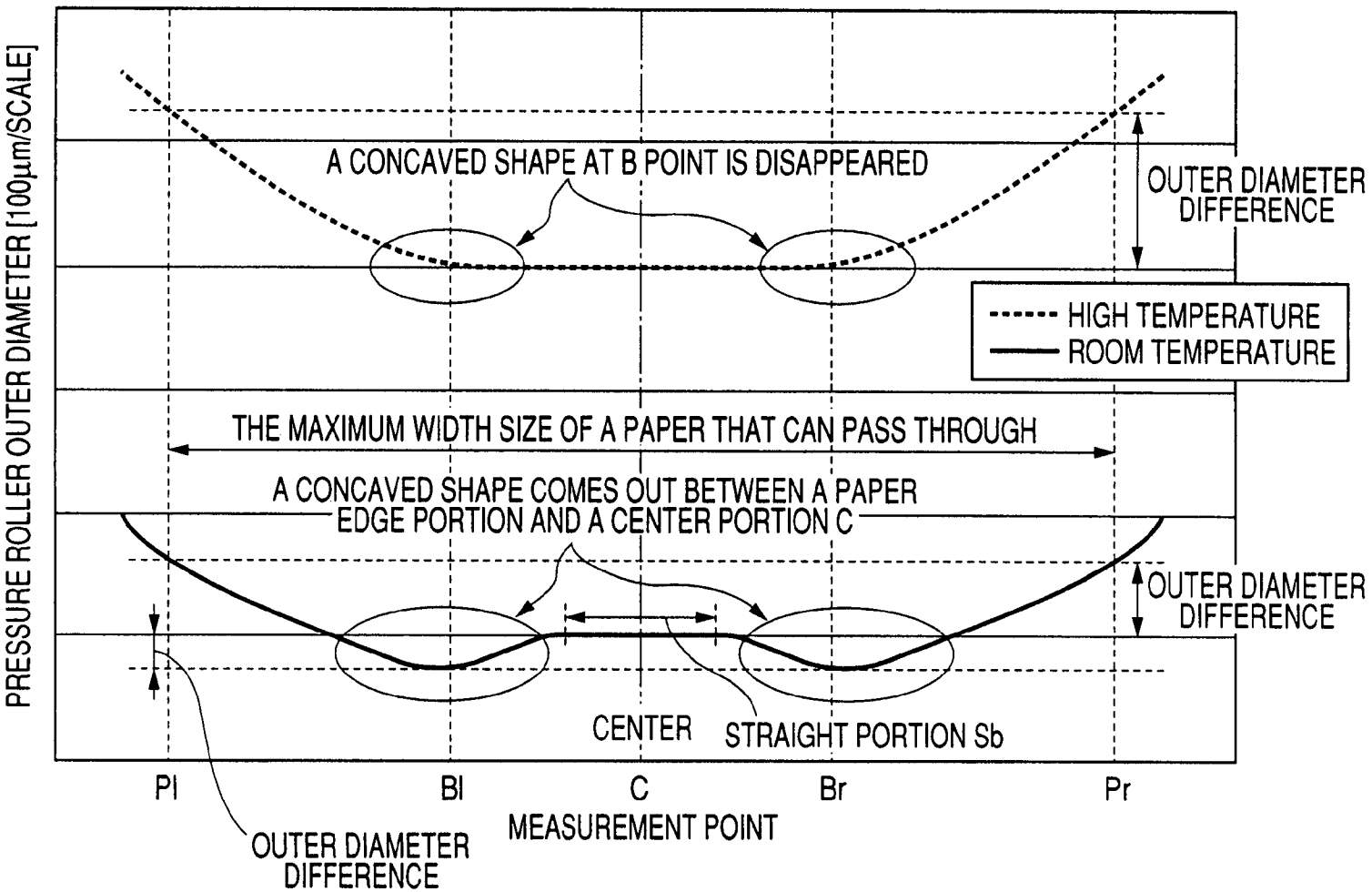
FIG. 6 is a chart showing an external profile of a pressure roller in the longitudinal direction in a room temperature state and a high temperature state (embodiment 1)

The external profile of the pressure roller in the longitudinal direction thereof, namely the surface shape of the elastic layer 26*b* in a state where it is contracted, is represented by a solid line in FIG. 6. As indicated by the solid line in FIG. 6, it has a straight portion (straight shape area) Sb in a central portion in the longitudinal direction. In the room temperature state, namely in a state where the pressure roller is cooled, the straight portion Sb on the surface of the elastic layer is approximately same or somewhat shorter than the straight portion Sa of the metal core 26*a*. Also the profile has a concave shape with a minimum external diameter at a point B (Bl: at left side, Br: at right side) between the end of the straight portion Sb and a position P (Pl: at left side, Pr: at right side) corresponding to an end position (edge position) of the recording material of a maximum width that can be passed. The position of the minimum external diameter (point B) of the concave shape approximately coincides with the end of the straight portion Sd of the metal mold 26*d*.

The elastic layer at the room temperature state has a concave shape for following reason.

As will be understandable from FIG. 5, the elastic layer corresponding to the straight shape area Sd of the metal mold 26*d* has a diameter (namely diameter of the pressure roller) is same in a portion formed on the straight shape area Sa of the metal core and in a portion formed on the tapered area of the metal core, in the high temperature state. Also the elastic layer formed on the straight shape area Sa of the metal core 26*a* has a uniform thickness, but the elastic layer formed on the tapered area of the metal core 26*a* has a thickness gradually increasing toward the end portion.

The elastic layer of a larger thickness shows a larger contraction when the temperature is lowered. Therefore, in comparison with the elastic layer formed on the straight shape area Sa of the metal core 26*a*, the elastic layer of a larger thickness formed on the tapered area shows a larger contraction when the temperature is lowered. Consequently, when the temperature of the pressure roller is lowered, within the elastic layer corresponding to the straight shape area Sd of the metal mold 26*d*, the diameter of the elastic layer excluding the straight shape area Sa of the metal mold becomes gradually smaller toward the end portion of the pressure roller (first phenomenon), whereby an area of a decrease in diameter is generated.

On the other hand, in the crown portions of the metal mold from the end portions of the straight shape area Sd of the metal mold 26*d* to the ends Pr, Pl of the pressure roller (more exactly to the ends of passing area of the recording material of the maximum size), the internal surface of the metal mold 26*d* is so formed as to secure a predetermined inverse crown amount on the both end portions (positions Pr, Pl) of the elastic layer 26*b* with respect to the straight shape area in the central portion, even when the pressure roller 26 is at a room temperature state, namely when the elastic layer 26*b* is contracted. In order to obtain such shape of the elastic layer at the room temperature state, the diameter of the metal core 26*a* decreases linearly (in a manner of a first-order function) toward the end portion, while the internal diameter of the metal mold 26*d* increases in a curve of a manner of a second-order function. As a result, the internal diameter of the metal mold 26*d* increases more than an increase in the contraction resulting from an increase in the thickness of the elastic layer 26*b* toward the end of the pressure roller. Thus, the diameter of the elastic layer in areas from the ends of the straight shape area Sd of the metal mold 26*d* to the ends Pr, Pl of the pressure roller increases gradually toward the ends of the pressure roller, regardless of the temperature thereof (second phenomenon).

Because of the first and second phenomena mentioned above, on the surface of the pressure roller 26 at the room temperature state, namely when it is cooled, concave portions are formed with a minimum diameter at points B (Br, Bl).

On the other hand, the pressure roller 26 at the high temperature state is at a temperature approximately equal to the hardening temperature as indicated by a broken line in FIG. 6. For this reason, the pressure roller 26 has an external profile in the longitudinal direction close to the shape of the metal mold 26*d* and the concave portion at the point B at the room temperature disappears. Thus, it has a straight portion, in a central portion C, of a length substantially equal to the length Sd of the central straight portion of the metal mold 26*d* and an inverted crown shape of a curve of a manner of a second-order function from the ends of such straight portion toward both ends.

Also, as the pressure roller 26 has a straight portion in the central portion C in the longitudinal direction regardless whether the rubber material of the elastic layer 26*b* has a thermal expansion or not, the thermistor 21 can always be positioned on the rear surface (opposite to the nip forming surface) of the heater corresponding to the straight portion of the pressure roller 26.

Figure 12:
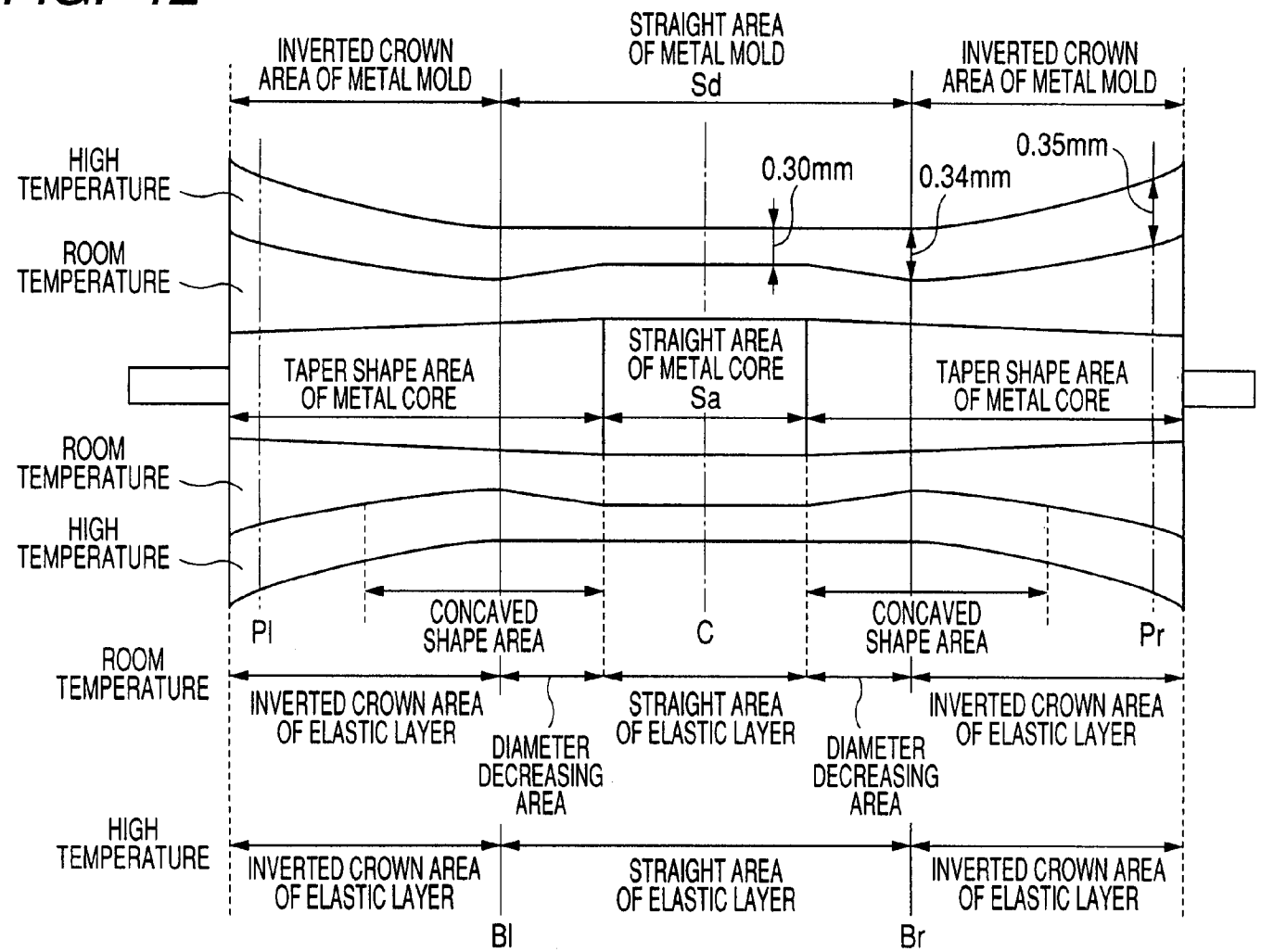
FIG. 12 is a view for comparing, in the pressure roller of the first embodiment, a cross sectional shape in a high temperature state and that in a low temperature state.

As explained in the foregoing, the pressure roller of the present embodiment has different external profiles at a high temperature state and a low temperature state, and such difference is summarized in FIG. 12. As will be understood from FIG. 12, the pressure roller 26 of the present embodiment includes a metal core 26*a* and an elastic layer 26*b* provided outside the metal core 26*a*. The metal core 26*a* has a straight shape area Sa of a substantially uniform diameter along the longitudinal direction, in a central portion of the longitudinal direction, and tapered areas with a gradually decreasing diameter on both sides of the straight shape area Sa. Also the elastic layer 26*b* has, regardless of the temperature state thereof, a straight shape area of a substantially uniform diameter along the longitudinal direction, in a central portion in the longitudinal direction, and inverted crown areas with a gradually increasing diameter toward the ends in the longitudinal directions, on both sides of the straight shape area.

Also the elastic layer 26*b* corresponding to the straight shape area Sa of the metal core has a substantially uniform thickness, while the elastic layer 26*b* corresponding to the tapered area of the metal core 26*a* increases gradually toward the ends in the longitudinal direction.

Also when the pressure roller 26 is in a cooled state (room temperature state), the surface of the pressure roller 26 corresponding to the tapered area of the metalc core 26*a* has a recessed portion (concave portion), and such concave portion disappears when the elastic layer 26*b* is thermally expanded (high temperature state).

Also in the thermally expanded state of the elastic layer 26, the longitudinal length of the straight shape area of the elastic layer 26*b* is longer than the longitudinal direction of the straight shape area Sb when the pressure roller 26 is cooled.

FIG. 12 also shows, as reference values in the pressure roller employed in the present embodiment, an expansion (contraction) of 0.30 mm in the elastic layer on the straight shape area of the metal core, an expansion (contraction) of 0.34 mm in the elastic layer in the point B, and an expansion (contraction) of 0.35 mm in the elastic layer in the point P. Although the contraction in the point P is larger than that in two other points, the elastic layer has a larger diameter than in two other points because of the design in the shapes of the metal mold 26*d* and the metal core 26*a*. It will also be understood that the expansion (contraction) of the elastic layer in the point B is larger than the expansion (contraction) of the elastic layer on the straight shape area of the metal core.

The present embodiment employs, as an example, an aluminum metal core 26*a* having a length of 216 mm between Pr and Pl, a maximum diameter ϕDc of 23 mm in the central portion C, a length Sa of 50 mm of the straight portion, and a minimum diameter ϕDe of 21 mm in both ends (Pr, Pl). The elastic layer 26*b* is formed with silicone rubber. The metal mold 26*d* has a length Sd of 100 mm of the central straight portion, and a crown amount (difference between the internal diameter of the central portion and the internal diameter at the point P) of 120 μm. The pressure roller 26 in the room temperature state has an average diameter of 30 mmϕ, a length of the straight portion Sb of 40 mm somewhat shorter than the straight portion Sa of the metal core, a difference in external diameter (ΔP−C) constituting the inverted crown amount of 60 μm, and a difference in external diameter between the concave point B and the central portion C (ΔB−C) of 25 μm. Also at the high temperature state, the pressure roller 26 has an average diameter of 30.4 mmϕ, a length of the straight portion SB of 80 mm somewhat shorter than the straight portion Sd of the metal mold, and the external diameter difference constituting the inverted crown amount of 120 μm, wherein the concave shape in the point B vanishes.

(3) Comparative Experiment with Prior Example

Figure 9:
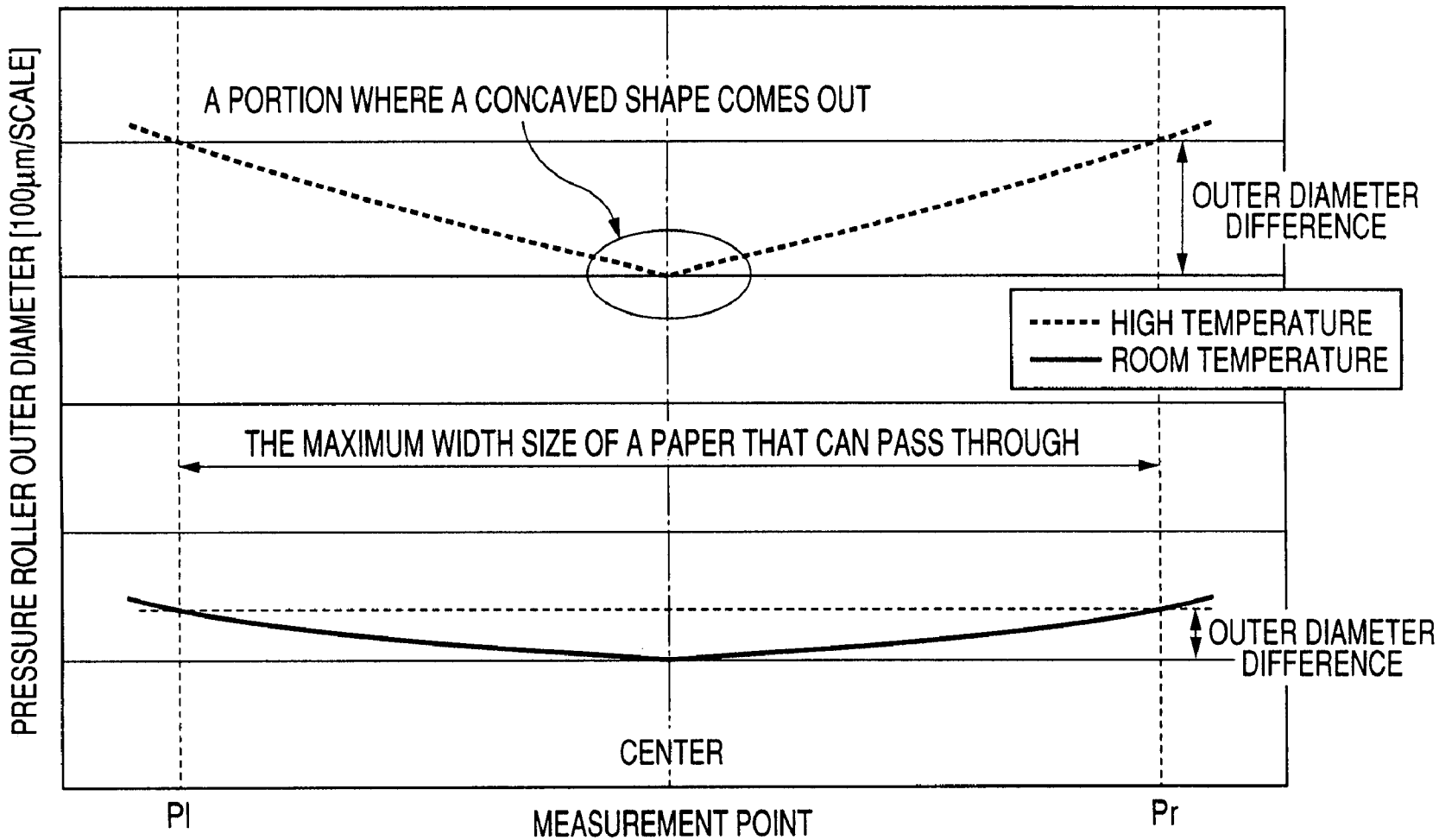
FIG. 9 is a chart showing an external profile of a pressure roller, having an inverted crown profile at a room temperature state and a high temperature state.
Figure 10:
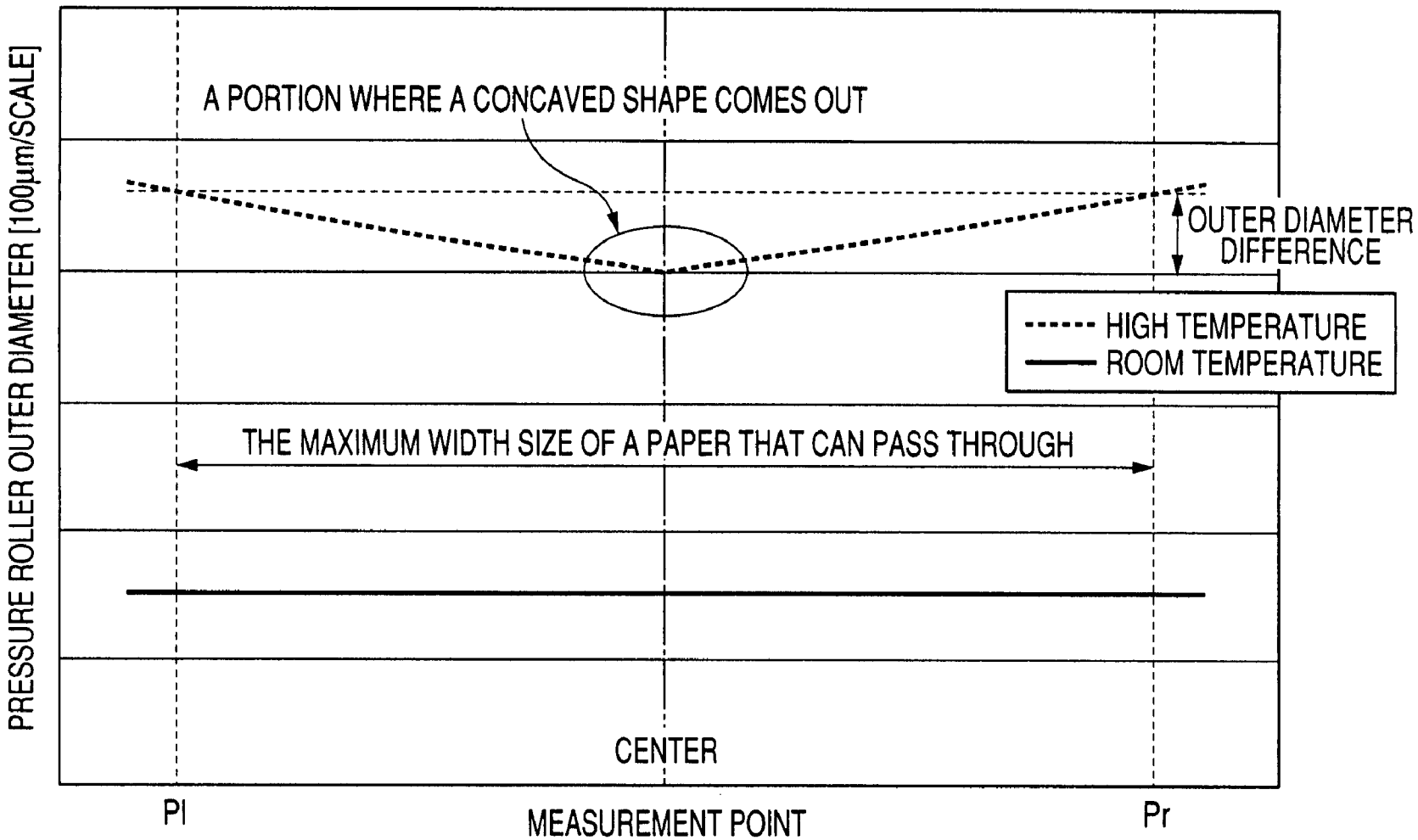
FIG. 10 is a chart showing an external profile of a pressure roller, having a straight profile at a room temperature state, at a room temperature state and a high temperature state.
Figure 11:
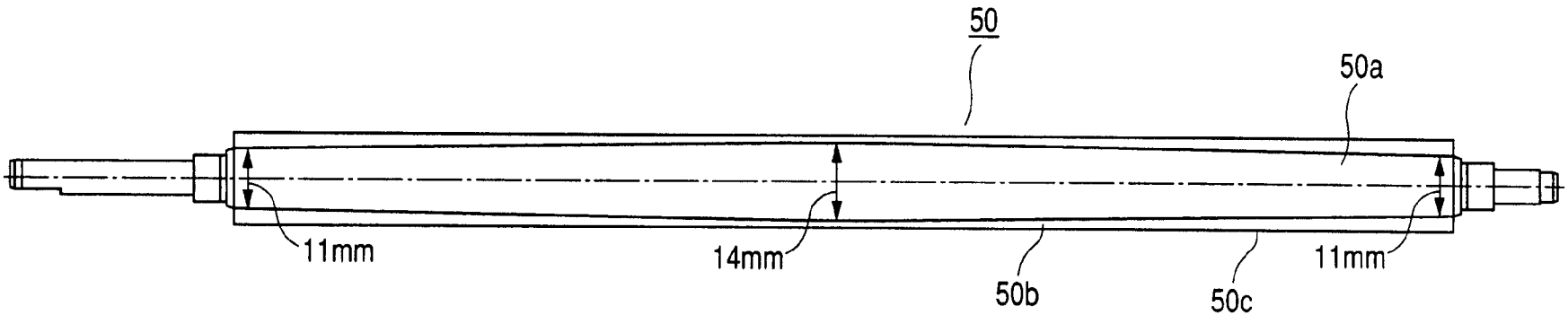
FIG. 11 is a cross-sectional view of a prior pressure roller having a tapered metal core.

A pressure roller 26 of the aforementioned embodiment (FIG. 6), a pressure roller of a prior example 1 employing a tapered metal core and having a straight profile at the room temperature as shown in FIGS. 10 and 11, and a pressure roller of a prior example 2 having an inverted crown shape even at the room temperature state as shown in FIG. 9, in contrast to the prior example 1, were subjected to following three evaluations. Also a comparison with printer main bodies of different printing speeds (30 ppm, 40 ppm) was conducted.

(A) Evaluation of Toner Accumulation on the Surface of the Pressure Roller 26

A character pattern was printed continuously on 50,000 sheets, utilizing a paper Continental LX (manufactured by IGEPA Ltd.) containing calcium carbonate as a filler, in an environment of 15° C./10% RH, and a toner stain on the pressure roller and on the printed paper, at 5,000th and 50,000th sheets was evaluated.

(B) Evaluation of Paper Creases

A grid pattern of a pitch of 10 mm was continuously printed on 500 sheets, utilizing a thin paper Office Planner (manufactured by Canon Inc.), in an environment of 32.5° C./80% RH, and generation of creases in paper was confirmed.

(C) Evaluation of Fixing Property

A character pattern was printed continuously on 500 sheets, utilizing a rough surface paper Fox River Bond #24 (manufactured by Fox River Paper Co.), in an environment of 15° C./10% RH, and a fixing property was evaluated by a rubbing test and the like.

These results are shown in Table 1. In the table, (+) indicates a satisfactory level, (±) indicates a practically acceptable level, and (−) indicates an unacceptable level.

TABLE 1

| | this embodiment | | prior example 1 | | prior example 2 | |
|---|---|---|---|---|---|---|
| | Print speed | | | | | |
| Pressure roller | 30 ppm | 40 ppm | 30 ppm | 40 ppm | 30 ppm | 40 ppm |
| (1) toner accumulation | + | + | + | ± | ± | − |
| (2) paper creases | + | + | ± | − | + | + |
| (3) fixing property | + | + | + | ± | + | − |

Based on these results it is confirmed that the pressure roller 26 of the present embodiment can achieve, in comparison with the prior examples 1 and 2, a prevention of toner accumulation on the pressure roller in a continuous printing operation, a prevention of creases in the paper and a stable fixing property by an appropriate temperature control, even at an elevated printing speed.

The pressure roller of the prior example 1 shows a low suppressing ability for the paper creases as it cannot form an inverted crown shape in a low temperature state of the pressure roller.

Also the pressure roller of the prior example 2, having a large local concave portion in the central portion in the longitudinal direction at a high temperature state, shows a lower pressure in such central concave portion than in other portions within the fixing nip, thus receiving a smaller heat amount from the heater in such central concave portion. Therefore, the heater temperature becomes higher in the central portion where the thermistor is positioned in comparison with other portions, so that a sufficient heat amount is not supplied even when the temperature control is executed with an appropriate temperature. Consequently, the fixing property is deteriorated in the central portion, and a toner accumulation takes place as the temperature of the pressure roller becomes lower in the central portion, in comparison with other portions.

In contrast, the pressure roller 26 of the present embodiment has a straight portion Sb in the longitudinally central portion regardless of the presence/absence of thermal expansion of the elastic layer 26*b* by a temperature change, and also has a straight portion (Sa) with a maximum diameter of the metal core thereunder. Consequently, within the fixing nip, a high pressure is maintained in the central straight portion and an appropriate heat supply is realized from the heater 20 in the central straight portion. Thus the temperature of the heater becomes uniform in the central straight portion where the thermistor 21 is positioned, and a desired heat amount can be supplied from the heater 20 by an appropriate temperature control.

It is thus rendered possible to obtain a desired fixing property. Also the central straight portion of the pressure roller can have a desired uniform temperature, thereby avoiding a toner accumulation onto the pressure roller 26. Furthermore, in comparison with the central portion, the end portions corresponding to the maximum passable sheet size have a larger external diameter to form so-called inverted crown shape, thereby preventing creases in the paper.

Furthermore, as the metal core 26*a* has a straight portion (Sa) in the central portion and is tapered toward both ends, the pressure roller 26 is given so-called inverted crown shape, in which the thicker end portions of the elastic layer 26*b* show a larger diameter than in the central portion, by the thermal expansion of the elastic layer 26*b* for example in a continuous printing operation. Therefore, a tensile force toward the both ends is applied to the recording material P pinched and conveyed in the fixing nip portion N, thereby preventing generation of creases in the paper.

Also the pressure roller 26 is produced by setting the metal core 26*a* in a metal mold 26*d*, having a straight portion formed longer than the straight portion in the central portion of the metal core 26*a*, in such a manner that the straight portion of the metal mold 26*d* exceeds the straight portion of the metal core 26*a* on both lateral sides, and executing a molding operation in such state. In this manner it is rendered possible to form a straight portion securely in the central portion in the longitudinal direction of the pressure roller 26.

Second Embodiment

In the following there will be explained, with reference to the accompanying drawings, a second embodiment of a pressurizing rotary member, a fixing apparatus and an image forming apparatus. In the following, components equivalent to those in the first embodiment are represented by corresponding symbols and will not be explained in duplication.

Figure 7:
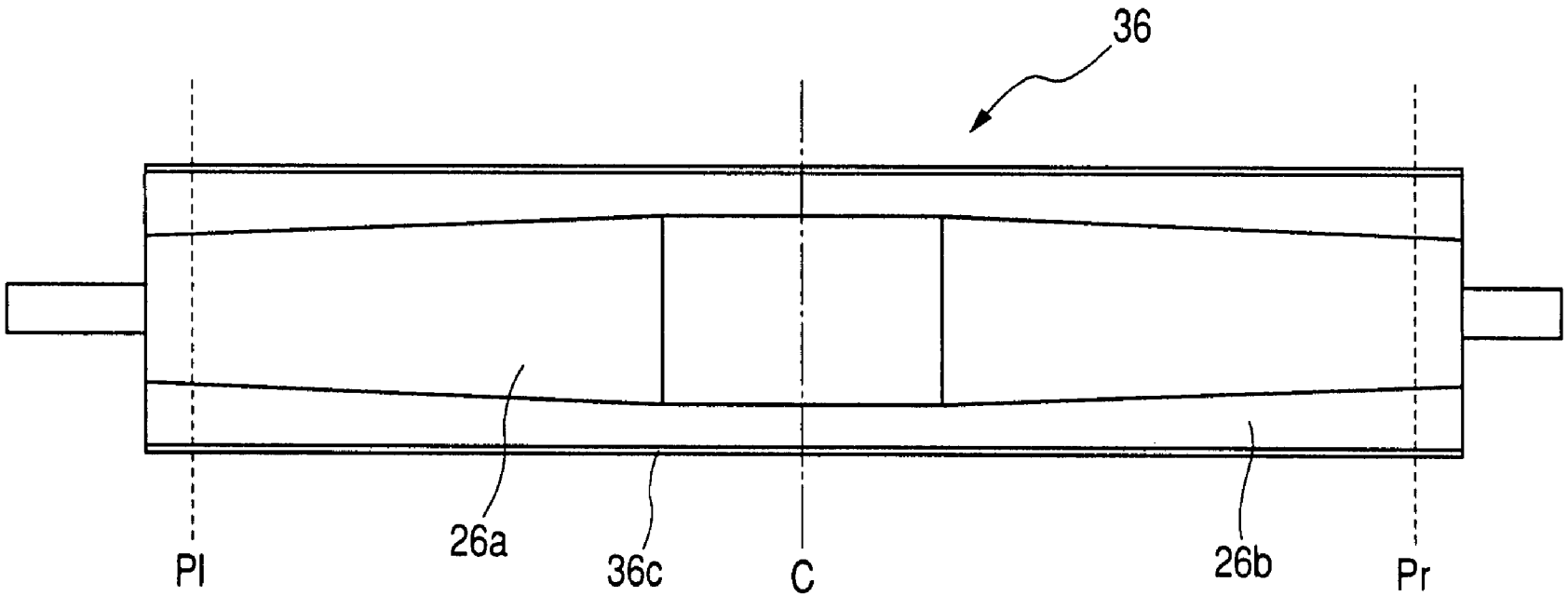
FIG. 7 is a cross-sectional view of a pressure roller in a second embodiment.

The pressurizing rotary member, the fixing apparatus and the image forming apparatus of the present embodiment employ, a pressure roller 36 shown in FIG. 7, instead of the pressure roller 26 of the first embodiment.

The pressure roller 36 shown in FIG. 7 is provided with a releasing layer 36*c* formed so as to cover an elastic layer 26*b* provided on the external periphery of a metal core 26*a*. The releasing layer 36*c* is formed by a fluorinated resin such as PFA, PTFE or FEP. The presence of such releasing layer 36*c* increases a margin against a surface abrasion in a sheet-passing durability test and also a margin against the aforementioned accumulation of the transferred toner, because of an improved releasing property.

The present embodiment for example employs, as in the first embodiment, an aluminum metal core 26*a* having a maximum diameter ϕDc of 23 mm in the central portion C, a length Sa of 50 mm of the straight portion, and a minimum diameter ϕDe of 21 mm in both ends. The elastic layer 26*b* is formed with silicone rubber. The metal mold 26*d* has a length Sd of 100 mm of the central straight portion, and a crown amount of 120 μm. The releasing layer 36*c* is formed by a seamless tube of PFA of a thickness of 50 μm. The releasing layer 36*c* can be provided on the elastic layer 26*b* for example by setting the releasing layer in the metal mold 26*d* in advance at the molding operation for the elastic layer 26*b*, or fitting the releasing layer 36*c* on the elastic layer 26*b* after the hardening step, but such examples are not restrictive.

Figure 8:
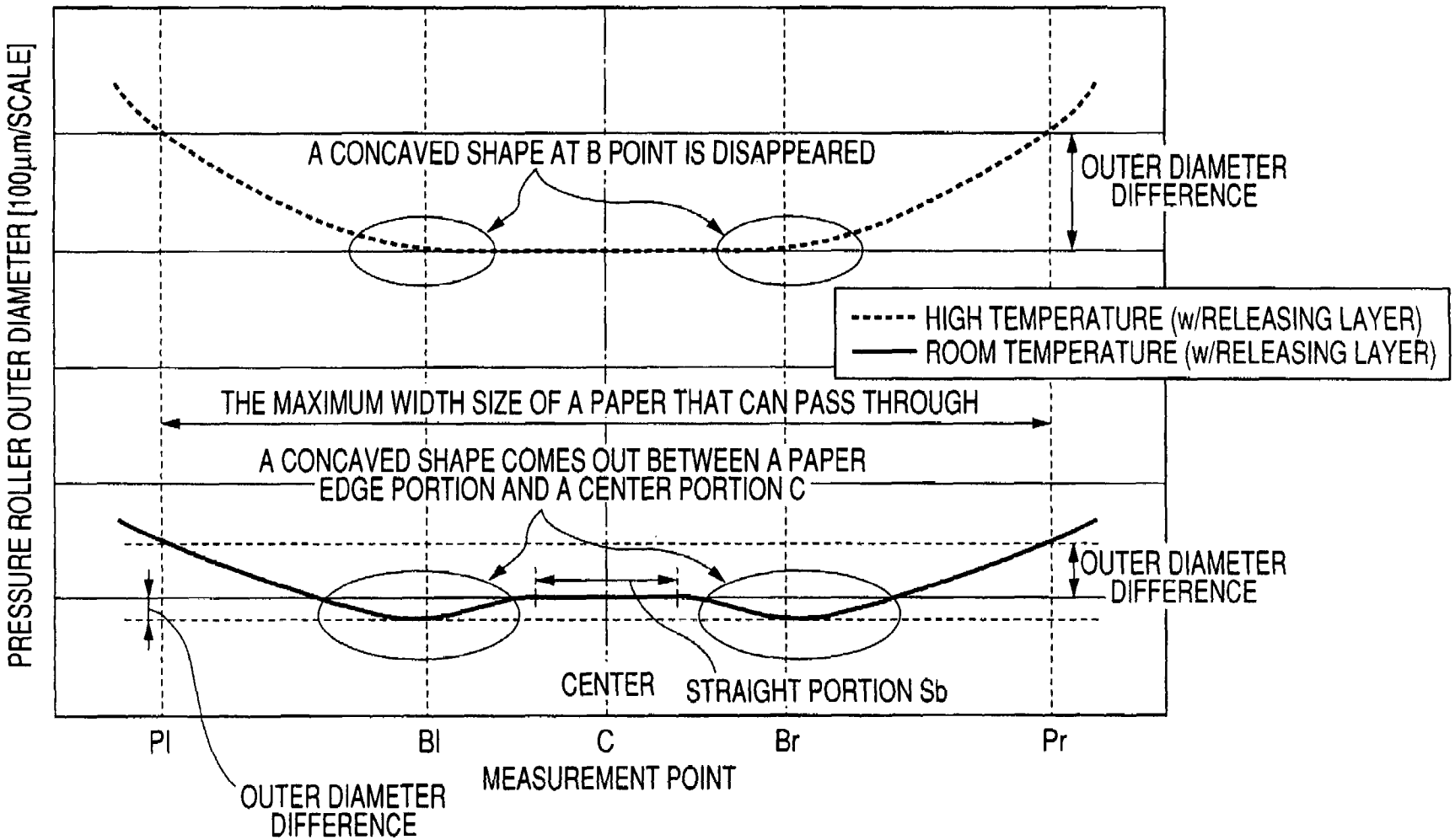
FIG. 8 is a chart showing an external profile of a pressure roller in the longitudinal direction in a room temperature state and a high temperature state (embodiment 2)

FIG. 8 shows an external profile in the longitudinal direction of the pressure roller 36 of the aforementioned configuration, in a room temperature state and in a high temperature state.

As shown in FIG. 8, the pressure roller 36 in the room temperature state has an average diameter of 30 mmϕ, a length of the straight portion Sb of 40 mm, a difference in external diameter (ΔP−C) constituting the inverted crown amount of 50 μm, and a difference in external diameter between the concave point B and the central portion C (ΔB−C) of 15 μm. Also at the high temperature state, the pressure roller 26 has an average diameter of 30.4 mmϕ, a length of the straight portion SB of 80 mm, and the external diameter difference constituting the inverted crown amount of 100 μm, wherein the concave shape in the point B vanishes.

The present embodiment, in comparison with the first embodiment, shows somewhat different changes in the external diameters by the thermal expansion or contraction of the elastic layer 26*b*, because of the presence of the releasing layer 36*c*. The presence of the releasing layer as in the present embodiment tends to reduce the changes in the external diameters. However, the concave shape in the point B disappears at the high temperature state to provide effects similar to those in the first embodiment, and an improvement in the releasing property is additionally obtained by the addition of the releasing layer 36*c*, whereby the margin against the toner accumulation can be further increased.

Comparative Experiment

The pressure roller 36 of the above-described present embodiment (FIG. 8) and the pressure roller 26 of the first embodiment (FIG. 6) were subjected to following three evaluations in a main body with a spring speed of 50 ppm.

(A) Evaluation of Toner Accumulation on the Surface of the Pressure Roller 26

A character pattern was printed continuously, utilizing a paper Continental LX (manufactured by IGEPA Ltd.) containing calcium carbonate as a filler, in an environment of 15° C./10% RH, and a toner stain on the pressure roller and on the printed paper, at 50,000th and 300,000th sheets was evaluated.

(B) Evaluation of Paper Creases

A grid pattern of a pitch of 10 mm was continuously printed on 500 sheets, utilizing a thin paper Office Planner (manufactured by Canon Inc.), in an environment of 32.5° C./80% RH, and generation of creases in paper was confirmed.

(C) Evaluation of Fixing Property

A character pattern was printed continuously on 500 sheets, utilizing a rough surface paper Fox River Bond #24 (manufactured by Fox River Paper Co.), in an environment of 15° C./10% RH, and a fixing property was evaluated by a rubbing test and the like.

These results are shown in Table 2. In the table, (+) indicates a satisfactory level, (±) indicates a practically acceptable level, and (−) indicates an unacceptable level.

TABLE 2

| Pressure roller | present embodiment | | first embodiment | |
|---|---|---|---|---|
| (1) toner accumulation | 50,000th print | 300,000th print | 50,000th print | 300,000th print |
| | + | + | ± | − |
| (2) paper creases | + | | + | |
| (3) fixing property | + | | + | |

Based on these results it is confirmed that the pressure roller 36 of the present embodiment can achieve, in comparison with that of Example 1, a prevention of toner accumulation on the pressure roller in a continuous printing operation, a prevention of creases in the paper and a stable fixing property by an appropriate temperature control, even at a further elevated printing speed and a longer service life.

In the pressure roller 26 of the prior example 1, the temperature of the pressure roller is not so elevated by a further increased printing speed so that the prevention of the toner accumulation by the roller shape only reaches a limit, and the roller surface is roughened by an abrasion by the paper surface in the prolonged paper-passing durability test, thereby resulting in a toner accumulation.

On the other hand, the pressure roller 36 of the present embodiment has, in addition to the effects of the shape explained in the first embodiment, an improved releasing property of the roller surface itself by the addition of the releasing layer 36*c*, thereby reducing the amount of the toner transferred from the fixing film onto the pressure roller, and the roughening of the roller surface in the paper-passing durability test is negligibly small, whereby the toner accumulation on the pressure roller can be prevented.

The first and second embodiments have been explained by an example of the shapes of the metal core and the metal mold for the pressure roller. Therefore, the present invention is not particularly restricted in shape, as long as the external profile of the pressure roller in the longitudinal direction thereof can be provided with a straight portion in a central portion and with a concave shape between each end of such central straight portion and each end of the paper of the maximum passable size.

The heat fixing apparatus of the above-explained film heating method is of a type driven by a pressurizing rotary member, but it may also be of a type in which a driving roller is provided on an internal periphery of the endless fixing film and driving such film under a tension. It can also be of a type in which the film is constructed as a rolled web which is driven in a running motion.

The heat fixing apparatus of the present invention is not limited to a film heating type but can also be, for example, a heat roller type in which an image bearing recording material is pinched and conveyed by a nip between a heating member and a pressurizing rotary member thereby heating the image on the recording material.

Also the heater is not limited to a ceramic heater but can be an electromagnetic inductive heat-generating member such as an iron plate. For example there can be employed a configuration of positioning an electromagnetic inductive heat-generating member such as an iron plate, as the heater in the fixing nip portion, and applying thereto a high frequency magnetic field generated by a magnetic coil and a magnetic core as AC magnetic flux generating means thereby generating a heat. Also there may be employed a configuration in which the film itself as the moving member is constructed by an electromagnetic inductive heat-generating member and heat is generated by AC magnetic flux generating means.

Furthermore, the heat fixing apparatus of the present invention is applicable not only to a fixing apparatus for heat fixing an unfixed image permanently on a recording material, but also to a heating apparatus for temporarily fixing an unfixed image on a recording material, or a heating apparatus for re-heating an image-bearing recording material thereby improving a surface property such as gloss of the image.

Furthermore, the image forming method of the image forming apparatus is not limited to an electrophotographic method, but can also be an electrostatic recording method or a magnetic recording method, and can also be a transfer process or a direct process.

The present invention is not limited to the aforementioned embodiments but includes any and all modifications within the technical concept.

This application claims priority from Japanese Patent Application No. 2004-099651 filed Mar. 30, 2004 and Japanese Patent Application No. 2005-087831 filed Mar. 25, 2005 which are hereby incorporated by reference herein.

What is claimed is:

1. An image heating apparatus for heating an image formed on a recording material, comprising:

a conveying roller for conveying the recording material, said conveying roller including a metal core and an elastic layer provided outside said metal core;

wherein said metal core including a straight shape area, in a central portion of a longitudinal direction thereof, having a substantially uniform diameter along the longitudinal direction, and tapered shape areas, on both sides of the straight shape area, in which a diameter gradually decreases toward ends in the longitudinal direction;

wherein said elastic layer including a straight shape area, in a central portion of a longitudinal direction thereof, having a substantially uniform diameter along the longitudinal direction, and inverted crown shape areas, on both sides of the straight shape area, in which a diameter gradually increases toward ends in the longitudinal direction; and said conveying roller has a recess in a surface thereof corresponding to the tapered shape area of said metal core, in a state where said conveying roller is cooled.

2. An image heating apparatus according to claim 1, wherein:

said elastic layer corresponding to the straight shape area of said metal core has a substantially uniform thickness; and said elastic layer corresponding to the tapered shape area of said metal core has a thickness gradually increasing toward the end in the longitudinal direction.

3. An image heating apparatus according to claim 1, wherein:

said recess disappears in a state where said elastic layer is thermally expanded.

4. An image heating apparatus according to claim 1, wherein:

a length of the straight shape area of said elastic layer in the longitudinal direction in a state where said elastic layer is thermally expanded is larger than a length of the straight shape area of said elastic layer in the longitudinal direction in a state where said conveying roller is cooled.

5. An image heating apparatus according to claim 1, wherein:

a diameter of said metal core in the tapered shape area thereof decreases in a manner of a first-order function and a diameter of said elastic layer in the inverted crown shape area increases in a manner of a second-order function.

6. An image heating apparatus according to claim 1, wherein:

said conveying roller further includes a surface resin layer.

7. An image heating apparatus according to claim 1, wherein:

said conveying roller function as a pressure roller.

8. An image heating apparatus according to claim 7, further comprising:

a heater;

a flexible sleeve rotating in contact, on an internal surface thereof, with said heater;

a temperature detecting element for detecting a temperature of said heater; and control means which controls a current supply to said heater in such a manner that a temperature detected by said temperature detecting element is maintained at a set temperature;

wherein said heater and said pressure roller forms a nip portion through said flexible sleeve for conveying the recording material, and said temperature detecting element is provided in the straight shape area of said metal core.

9. A conveying roller for use in an image heating apparatus which pinches and conveys a recording material thereby heating an image thereon, the roller comprising:

a metal core; and an elastic layer provided outside said metal core;

wherein said metal core including a straight shape area, in a central portion of a longitudinal direction thereof, having a substantially uniform diameter along the longitudinal direction, and tapered shape areas, on both sides of the straight shape area, in which a diameter gradually decreases toward ends in the longitudinal direction;

wherein said elastic layer including a straight shape area, in a central portion of a longitudinal direction thereof, having a substantially uniform diameter along the longitudinal direction, and inverted crown shape areas, on both sides of the straight shape area, in which a diameter gradually increases toward ends in the longitudinal direction; and said conveying roller has a recess in a surface thereof corresponding to the tapered shape area of said metal core, in a state where said conveying roller is cooled.

10. A conveying roller according to claim 9, wherein:

said elastic layer corresponding to the straight shape area of said metal core has a substantially uniform thickness; and said elastic layer corresponding to the tapered shape area of said metal core has a thickness gradually increasing toward the end in the longitudinal direction.

11. A conveying roller according to claim 9, wherein:

said recess disappears in a state where said elastic layer is thermally expanded.

12. A conveying roller according to claim 9, wherein:

a length of the straight shape area of said elastic layer in the longitudinal direction in a state where said elastic layer is thermally expanded is larger than a length of the straight shape area of said elastic layer in the longitudinal direction in a state where said conveying roller is cooled.

13. A conveying roller according to claim 9, wherein:

a diameter of said metal core in the tapered shape area thereof decreases in a manner of a first-order function and a diameter of said elastic layer in the inverted crown shape area increases in a manner of a second-order function.

14. A conveying roller according to claim 9, wherein:

said conveying roller further includes a surface resin layer.

15. A conveying roller according to claim 9, wherein:

said conveying roller effects being a pressure roller.

* * * * *

UNITED STATES PATENT AND TRADEMARK OFFICE

CERTIFICATE OF CORRECTION

PATENT NO. : 7,251,447 B2
APPLICATION NO. : 11/091638
DATED : July 31, 2007
INVENTOR(S) : Akihito Kanamori et al.

It is certified that error appears in the above-identified patent and that said Letters Patent is hereby corrected as shown below:

COLUMN 3
Line 10, “thus” should read --the--.
Line 26, “capable” should read --capable of--.
Line 33, “core;” should read --core,--.
Line 35, “having” should read --has--.
Line 40, “having” should read --has--.
Line 47, “core;” should read --core,--.
Line 49, “having” should read --has--.
Line 54, “having” should read --has--.

COLUMN 4
Line 19, delete “at a room temperature state,”.

COLUMN 7
Line 9, “guide” should read --holder--.

COLUMN 8
Line 1, “cross sectional” should read --lateral--.
Line 57, “for” should read --for the--, and “reason.” should read --reasons.--.
Line 61, “roller)” should read --roller) that--.
Line 67, “portion.” should read --portions.--.

COLUMN 9
Line 27, “portion,” should read --portions,--.

COLUMN 10
Line 21, “metalc” should read --metal--.
Line 26, “”26,” should read --26b,--.
Line 63, “portion SB” should read --portion Sb--.

COLUMN 11
Line 8, “to” (second occurrence) should read --to the--.

UNITED STATES PATENT AND TRADEMARK OFFICE

CERTIFICATE OF CORRECTION

PATENT NO. : 7,251,447 B2
APPLICATION NO. : 11/091638
DATED : July 31, 2007
INVENTOR(S) : Akihito Kanamori et al.

It is certified that error appears in the above-identified patent and that said Letters Patent is hereby corrected as shown below:

COLUMN 13
Line 32, “roller 26” should read --roller 36--.
Line 33, “portion SB” should read --portion Sb--.
Line 54, “to” should read --to the--.
Line 55, “spring” should read --printing--.

COLUMN 15
Line 45, “having” should read --has--.
Line 52, “having” should read --has--.
Line 67, “end” should read --ends--.

COLUMN 16
Line 27, “function” should read --functions--.
Line 53, “having” should read --has--.
Line 60, “having” should read --has--.

COLUMN 17
Line 7, “end” should read --ends--.

Signed and Sealed this

Third Day of June, 2008

JON W. DUDAS
*Director of the United States Patent and Trademark Office*